United States Patent [19]

Kremski

[11] Patent Number: 4,508,338

[45] Date of Patent: Apr. 2, 1985

[54] BUMPER RAIL COVER AND METHOD OF INSTALLING THE SAME

[76] Inventor: Jacob Kremski, 10440 S. State Rd., Goodrich, Mich. 48438

[21] Appl. No.: 211,755

[22] Filed: Dec. 1, 1980

[51] Int. Cl.[3] ..... A63D 15/06

[52] U.S. Cl. ..... 273/9; 29/450

[58] Field of Search ..... 273/3, 6, 7, 8, 9, 67 A, 273/54 B, DIG. 7, 67 D, 67 DA, 67 DB, 67 DC, 72 R, 72 A, 81 R, 81.2, 165; 29/450, 452

[56] References Cited

U.S. PATENT DOCUMENTS

| | | | |
|---|---|---|---|
| 226,827 | 4/1880 | Bensinger et al. | 273/9 |
| 655,503 | 8/1900 | Moffett | 273/9 |
| 1,323,516 | 12/1919 | Acland | 273/9 |
| 1,355,781 | 10/1920 | Rodgers | 29/235 |
| 1,652,671 | 12/1927 | Hoskin | 273/9 X |
| 2,038,840 | 4/1936 | Hall | 29/235 |
| 2,752,953 | 7/1956 | Schmidt | 29/450 |
| 2,755,088 | 7/1956 | Allman | 273/7 |
| 3,025,062 | 3/1962 | Duffin | 273/82 R |
| 3,115,912 | 12/1963 | Harris | 273/82 R |
| 3,278,184 | 10/1966 | Rosenbaum | 273/54 B X |
| 3,353,826 | 11/1967 | Traverse | 273/DIG. 7 |
| 3,733,072 | 5/1973 | Nielsen | 273/7 |

*Primary Examiner*—Richard C. Pinkham
*Assistant Examiner*—T. Brown
*Attorney, Agent, or Firm*—Leonard Bloom

[57] ABSTRACT

A cover for a bumper rail for a pool table or the like and a method of installing the same wherein the cover includes a sleeve of fabric at least a portion of which is of elastic material wherein the sleeve may be expanded slightly and slipped over the outer surface of the rail into a position so as to extend throughout the length of the rail in overlying, tight-fitting engagement with the rail outer surface, the sleeve being of a length so as to provide end portions extending past the ends of the rail which end portions are folded back behind the rail and secured thereto.

2 Claims, 3 Drawing Figures

FIG 1
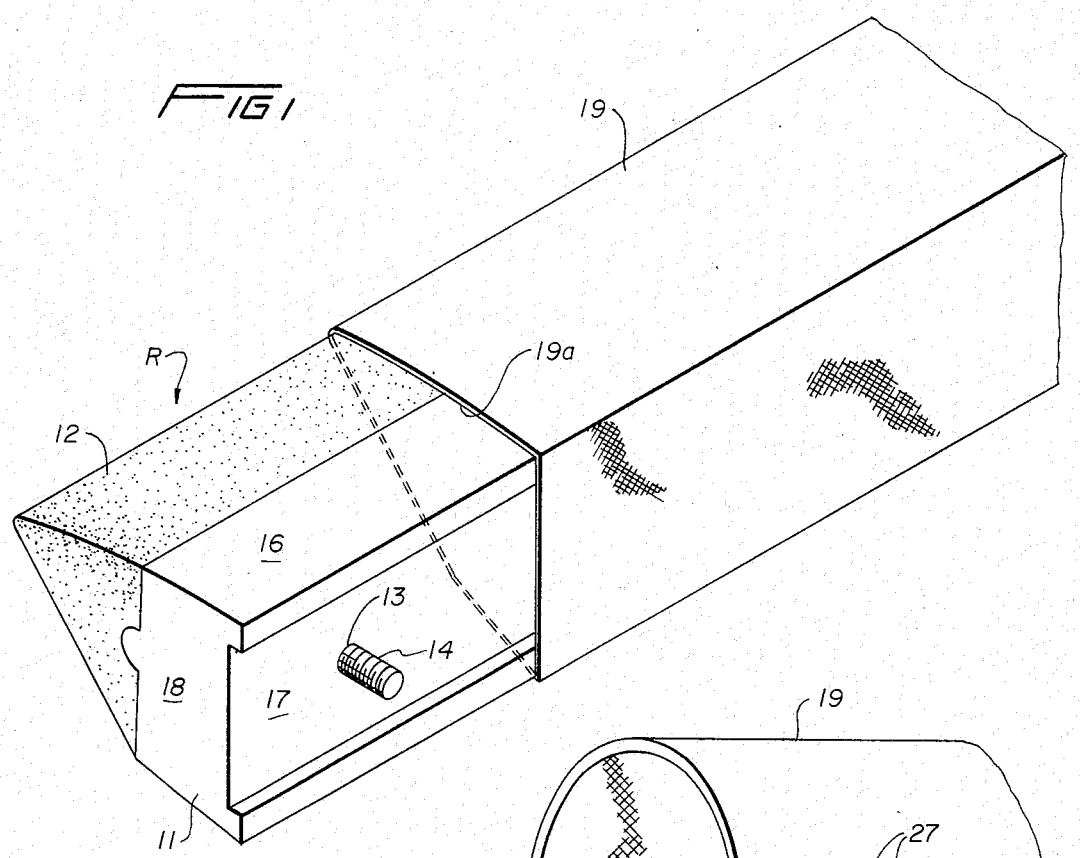
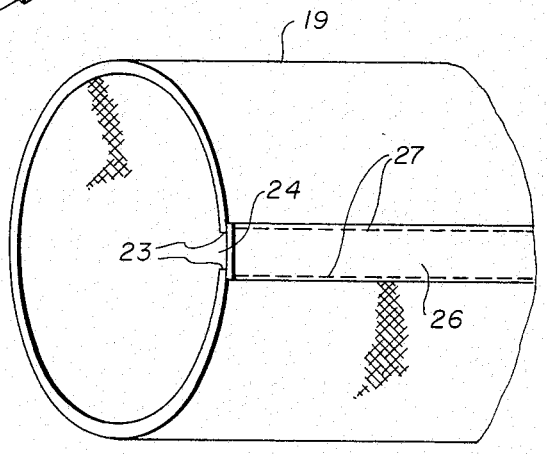
FIG 3
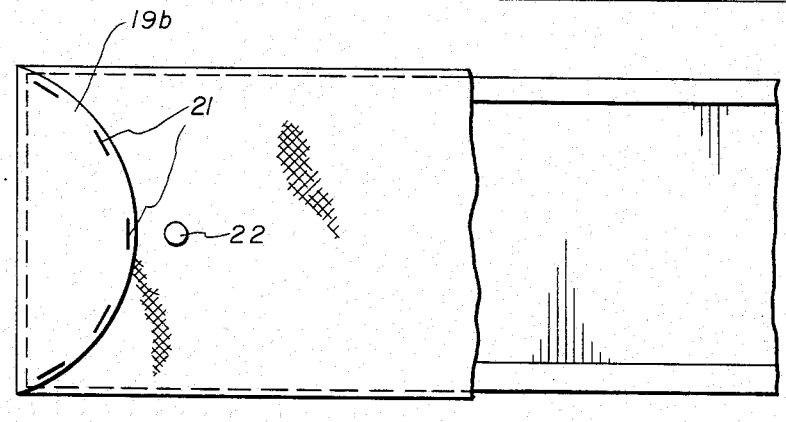
FIG 2

BUMPER RAIL COVER AND METHOD OF INSTALLING THE SAME

BACKGROUND OF THE INVENTION

In the construction of a typical game table and, in particular, a billard or pool table a "bumper rail" is provided along the inner marginal edges of the table, against which the balls impinge during the playing of the game. In the well known construction, such bumper rails have an inwardly directed resilient portion formed of rubber or the like so that the proper degree of bounce or ricochet is obtained by the ball. Such bumper rails are generally covered with a cloth of suitable textile material which completely surrounds projecting portions of the rail.

This cloth is usually installed on the rail by stretching a suitable fabric into a taut condition over the exposed face of a rail and the edges of the cloth which extend over the rear surface of the rail is stapled to the rail. The excess fabric after stapling is then trimmed. As can be understood, the installation of this cloth or fabric on a bumper rail under present day techniques requires a high degree of skill and is quite time consuming adding materially to the production costs of such game tables. Furthermore, under the best of conditions, uniformity in tautness throughout the fabric is not always obtained so that the quality standards desired for such pool tables falls short of the desired degree.

The following U.S. patents are representative of the prior art to which the subject invention is directed: Nos.

Moffett 655,503
Acland 1,323, 516
Hoskin 1,652,671
Allman 2,755.088
Nielsen 3,733,072

The Moffett patent discloses the use of a tubular sleeve for overlying a bumper cushion in a game table wherein the fabric of the sleeve is tensioned by a screw mechanism. In the Hoskin patent a block is utilized to tension the tubular sleeve in a taut condition over the bumper rail. The Acland, Allman and Nielsen patents are substantially different from that of the subject invention and are considered to be not particularly pertinent. All of the installation techniques used in the prior art patents for covering a bumper rail are quite complicated and expensive and do not necessarily provide a uniformly taut sleeve on the bumper rail.

OBJECTS AND SUMMARY OF THE INVENTION

Accordingly, a primary object of this invention is to provide a new and novel cover for the bumper rail of a game table such as a billard or pool table.

Another object of this invention is to provide a new and novel method of installing a cloth cover on the bumper rail of a game table such as a billard or pool table.

A further object of this invention is to provide a new and novel method of installing a cloth cover on a pool table bumper rail which may be carried out in a simple and easy manner at a high production rate by relatively unskilled personnel.

Still another object of this invention is to provide a new and novel cover for a pool table bumper rail which is inexpensive in cost and which in the installed position provides a highly uniform covering for the bumper rail throughout.

Still another object of this invention is to provide a new and novel cover for a pool table bumper rail and a method for installing same in which the cover is maintained in tight fitting engagement throughout the exposed surfaces of the bumper rail and in which the cover is installed by means which are invisible in the finished construction.

Other objects and advantages will become apparent in the following specification when considered in light of the attached drawings.

BRIEF DESCRIPTION OF THE DRAWINGS

FIG. 1 is a perspective view of a bumper rail illustrating an intermediate step in the installation of the bumper rail cover of the invention;

FIG. 2 is a rear elevation view of the bumper rail of FIG. 1 showing the cover in the installed position; and FIG. 3 is a side view of a modification of the bumper rail cover of the invention.

DESCRIPTION OF THE PREFERRED EMBODIMENTS

Referring now to the drawings and to FIG. 1 in particular there is shown a bumper rail for a game table such as a billard table or a pool table which is designated generally by the letter R. The bumper rail R is of conventional construction and includes a base member 11 preferably of wood or the like having a portion of resilient material such as rubber or the like of substantially triangular configuration and designated by the reference number 12.

As is well known, the bumper rail R is arranged to be mounted along the sides and at the top of a pool table so that the rubber portion 12 projects inwardly over the playing surface of the table. In the usual construction, the base member 11 is provided with bores 13 arranged in longitudinally spaced relationship along the length of the rail R for accommodating mounting bolts 14 which engage in suitable recesses provided in the frame of the pool table for attachment to the table by means of nuts (not shown) or the like.

In the assembled form, the bumper rail R includes an outer surface 16 a rear surface 17 and end walls 18. Prior to installation of the bumper rail R on the pool table, the rail R is covered with a cloth covering which in the illustrated embodiment includes a sleeve 19 of textile sheet material at least a portion of which is formed of elastic textile material. In the preferred embodiment, the sleeve 19 is formed entirely of elastic material which may be a blend of fibers. By way of example, a suitable blend of fibers to impart some elasticity to the sleeve 19 may be acrylic and nylon fibers in a proportion of 65% acrylic and 35% nylon fibers.

In the installation of the cover 19 in accordance with the novel method of the invention the elastic sleeve 19 is expanded slightly and the bumper rail R is inserted within the interior 19*a* of the sleeve 19 so that the sleeve may be drawn over the rail R in covering relationship with the rail outer surface 16. The expansion of the sleeve 19 to accommodate the bumper rail R may be carried out by the use of metal tube or the like which is withdrawn after the sleeve 19 has been installed in overlying relationship with the bumper rail R. The sleeve 19 is then permitted to contract so that it moves into overlying, tight fitting engagement throughout the outer surface 16 of the bumper rail R.

In the preferred embodiment, the length of the sleeve 19 is selected so as to provide end portions 19*b* which extend outwardly from each end of the bumper rail R past the end walls 18 in the installed position of the sleeve 19. The installation of the sleeve 19 is then completed in accordance method of the invention by folding over these end portions 19*b* over the bumper rail end walls 18 and stapling or otherwise securing the end portions 19*b* to the rear surface 17 of the bumper rail R as shown best in FIG. 2. In the illustrated embodiment, staples 21 are utilized for stapling the sleeve end portions 19*b* to the bumper rail surface 17.

As can be understood, the bolts 14 projecting rearwardly from the bumper rail R must penetrate the sleeve 19 in the installed position and this penetration can be provided by punching a plurality of longitudinal spaced openings 22 in the sleeve 19. In an alternate arrangement, the projecting portions of bolts 14 may be simply pushed through the sleeve 19 so as to project rearwardly thereof for securing the covered bumper rail R to the associated frame of the pool table.

FIG. 3 shows a modification of the bumper rail cover of the invention which is designated generally by the reference numeral 19'. In the modification of FIG. 3, the sleeve 19' may be made of conventional non-stretchable textile fabric and produced in the form of a split tube having longitudinally extending edges 23 forming a gap 24. The modified sleeve 19' is then provided with a longitudinally extending strip 26 of elastic material such as the material of the sleeve 19 which is secured to the longitudinally extending side edges 23 of the sleeve 19' by suitable means such as stitches 27 thereby bridging the gap 24. The method of the installation of the sleeve 19' would therefore be the same as installation of the sleeve 19 in that it is expanded slightly, inserted over the bumper rail R and permitted to contract into overlying, tight fitting engagement with the bumper rail outer surface 16. The projecting edge portions of the sleeve 19' are then suitably secured to the rear surface 17 of the bumper rail R. It should be understood, however, that the longitudinally extending strip of elastic material may be formed integrally with the non-stretchable portion of the sleeve 19' and installed in the same manner. The advantages of the novel cover and method of installing the cover in accordance with the invention can be easily understood. The sleeve 19 (or sleeve 19') may be produced in a supply roll of indeterminant length which may be stored on reels or the like. The resulting cover for the bumper rail R in easily installed and completely grips the outer surface of the bumper rail R in a highly uniform manner and is maintained thereon in such an installed position without risk of becoming slack or the like.

Having thus described the preferred embodiment of the invention it should be understood that numerous structural modifications and adaptations may be restored to without departing from the spirit of the invention.

What is claimed is:

1. A cover for the bumper rail of a pool table or the like, the bumper rail having a contoured outer surface including a resilient cushion on a front surface, a rear surface and end walls comprising, in combination, a sleeve of textile sheet material having open ends and a length corresponding substantially to the length of the bumper rail, at least a portion of said sleeve being formed of elastic textile material to allow said sleeve to be diametrically expanded for accommodating the bumper rail therein and for contraction of said sleeve into an installed position in overlying, tight-fitting engagement with the outer surface of the bumper rail and elastically deformable with the resilient cushion, wherein said sleeve has a length defining end portions extending outwardly beyond the bumper rail end walls and means for attaching said sleeve end portions to the rail rear surface with said sleeve end portions in overlying relationship with the bumper rail end walls.

2. A method for covering a bumper rail for a pool table or the like, the bumper rail having a contoured outer surface including a resilient cushion a rear surface, and end walls comprising the steps of, providing a sleeve of textile material having open ends and at least a longitudinally extending portion of elastic material, positioning said sleeve in an expanded condition on the outer surface of said bumper rail, and, permitting said sleeve to contract into overlying, tight fitting engagement with the outer surface of said rail, including providing said sleeve with a length greater than the length of the bumper rail to provide end portions of said sleeve extending outwardly from the rail end walls and including the further step of attaching said sleeve end portions to the rail rear surface in overlying relationship with a respective one of the rail end walls.

* * * * *